United States Patent [19]

Gonzales

[11] Patent Number: 4,557,312

[45] Date of Patent: Dec. 10, 1985

[54] PROCESS OF FABRICATING METAL ORNAMENTS

[76] Inventor: Ervey C. Gonzales, 6222 NW. Loop 14, Apt. 2B, San Antonio, Tex. 78238

[21] Appl. No.: 662,540

[22] Filed: Oct. 19, 1984

Related U.S. Application Data

[63] Continuation of Ser. No. 134,562, Mar. 27, 1980, abandoned, which is a continuation of Ser. No. 924,813, Jul. 14, 1978, abandoned.

[51] Int. Cl.[4] ..... B22C 9/02

[52] U.S. Cl. ..... 164/34; 164/45

[58] Field of Search ..... 164/27, 6, 45, 15, 17, 164/29, 34, 48; 33/23 R, 23 G, 23 H

[56] References Cited

U.S. PATENT DOCUMENTS

Re. 26,785 2/1970 Kaplan ..... 164/34

3,277,541 10/1966 Wilton et al. ..... 164/45

*Primary Examiner*—Nicholas P. Godici

*Assistant Examiner*—G. M. Reid

*Attorney, Agent, or Firm*—Schwartz & Weinrieb

[57] ABSTRACT

A process of fabricating metal ornaments, such as, for example, jewelry pieces, is disclosed. The inventive process includes the steps of producing a design image of an object or subject, to be incorporated within the ornament, onto a first working medium by means of a camera lucida. A pantograph is then employed for reproducing the image, normally upon a reduced scale, onto another working medium, such as, for example, casting wax, in order to produce a working model of the design image. A master mold is subsequently formed by means of lost wax techniques, and the final metal ornament is produced by casting the same within the master mold.

3 Claims, 1 Drawing Figure

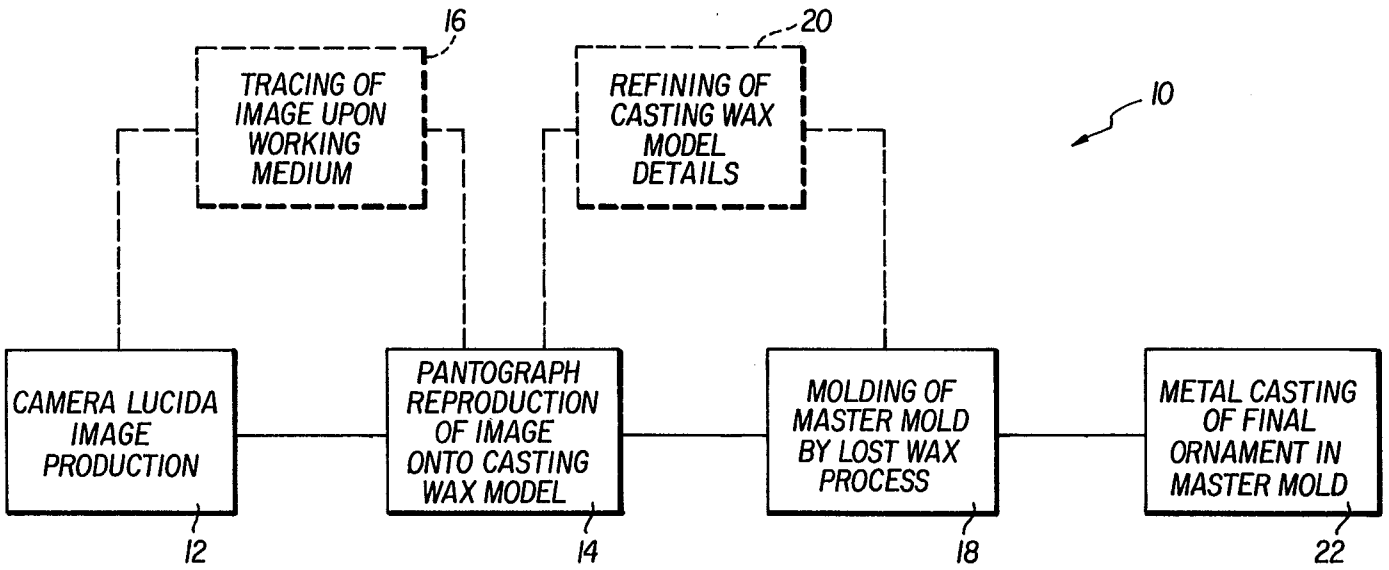
10
CAMERA LUCIDA IMAGE PRODUCTION
12
TRACING OF IMAGE UPON WORKING MEDIUM
16
PANTOGRAPH REPRODUCTION OF IMAGE ONTO CASTING WAX MODEL
14
REFINING OF CASTING WAX MODEL DETAILS
20
MOLDING OF MASTER MOLD BY LOST WAX PROCESS
18
METAL CASTING OF FINAL ORNAMENT IN MASTER MOLD
22

PROCESS OF FABRICATING METAL ORNAMENTS

This is a continuation of application Ser. No. 134,562 filed Mar. 27, 1980 now abandoned, which is a continuation Ser. No. 924,813 filed on July 14, 1978, now abandoned.

FIELD OF THE INVENTION

The present invention relates generally to processes of fabricating jewelry ornaments, and more particularly to a process of fabricating jewelry ornaments by means of molding and casting techniques whereby designs, accurately reproduced from master models, may be incorporated into the ornaments.

BACKGROUND OF THE INVENTION

A camera lucida is an instrument by which the image of an external subject or object can be made to appear upon a working medium, such as, for example, an easel, canvas, a sheet of drawing paper, or the like. Camera lucidas have been extensively employed in the past, for example, by various artisans for simultaneously viewing the virtual image of the subject or object, and the working medium upon which the external subject's image is to be transferred and reproduced, such as, for example, by means of a tracing process. While the prior art is replete with a wide variety of camera lucida devices capable of accomplishing the aforenoted image reproductions, such devices have not been employed in accordance with jewelry fabrication processes whereby the aforenoted external subject's image may be incorporated into particular jewelry ornaments as desired.

A pantograph is an instrument by which an image of a subject or object may be reproduced, the reproduction being manifested either in the nature of an enlargement or a reduction. A pantograph conventionally comprises an arrangement of articulated bars pivotally fastened together, and includes a scribing stylus and a marking or drawing implement, such as, for example, a pen, pencil, or the like. Depending upon the working mediums employed, either the stylus or the marking implement may be operatively associated with the master image to be reproduced while the other element achieves the reproduced image. Similarly, depending upon whether the reproduced image is to be an enlargement of a reduction of the master image, the stylus and marking implement may be interchangeably disposed within the master-image-reproducing and reproduced-image elements of the apparatus.

As in the instance of camera lucidas, while the prior art is similarly replete with a wide variety of pantograph devices capable of accurately reproducing images either as enlargements or as reductions of the original or master images, such devices have not been heretofore employed in connection with jewelry fabrication processes. Accordingly, while particular designs have been incorporated within innumerable jewelry ornaments by means of conventional techniques, such techniques are quite time consuming and expensive. In addition, the designs reproduced within the ornaments by such conventional techniques are necessarily limited with respect to the detail that may be achieved therewithin, and still further, the accuracy and quality of the images reproduced and incorporated within the ornaments is not entirely acceptable.

OBJECTS OF THE INVENTION

Accordingly, it is an object of the present invention to provide a new and improved process of fabricating jewelry ornaments.

Another object of the present invention is to provide a new and improved process of fabricating jewelry ornaments whereby the aforenoted deficiencies, characteristic of conventional jewelry fabrication processes or techniques, are overcome.

Still another object of the present invention is to provide a new and improved process of fabricating jewelry ornaments whereby virtually any design image may be accurately reproduced and incorporated within the ornaments.

Yet another object of the present invention is to provide a new and improved process of fabricating jewelry ornaments whereby the design image reproduced and incorporated within the ornaments exhibits a detail reproduction of the highest quality.

Still yet another object of the present invention is to provide a new and improved process of fabricating jewelry ornaments whereby the ornaments may be fabricated relatively simply, rapidly, and inexpensively.

SUMMARY OF THE INVENTION

The foregoing and other objects are achieved in accordance with the present invention through the provision of a process of fabricating jewelry ornaments which comprises the steps of initially producing an image of the subject or object onto a working medium, such as, for example, a sheet of drawing paper, by means of a camera lucida. A pantograph is then employed for reproducing the image, normally upon a reduced scale, onto another working medium, such as, for example, casting wax, in order to produce a working model of the subject or object design image to be incorporated into the jewelry ornaments.

The pantograph may be employed to transfer the details of the object design to the casting wax model directly from the image projected upon the first working medium, or alternatively, the image may be delineated upon the first working medium by the artisan by means of simply drawing or tracing over the lines comprising the object's image as projected onto the working medium by means of the camera lucida. The latter technique is preferred for then the artisan is able to work from a real, delineated image, as opposed to a projected image, when utilizing the pantograph for the image reproduction. This technique exhibits greatly improved results, as compared to the former technique, due to the feet that enhanced design detail reproduction is able to be achieved.

Subsequent to the formation of the casting wax model, a master mold for casting the final ornaments is produced by means of lost wax techniques. In accordance with such techniques, mold plaster material surrounds the casting wax model, and as a result of the exothermic plaster hardening or setting process, the wax model melts, the wax is lost, and the master mold remains.

Prior to the formation of the master mold, the casting wax model may be manually worked upon by the artisan in order to refine the details of the ornamental design still further beyond the state created by means of the pantograph. For example, shading and depth characteristics may be impressed upon the design in a manner not practically feasible by means of the pantographic image reproduction. This teachnique is obviously preferred for again greatly improved results are achieved due to the enhancement of the reproduced design details.

Lastly, the metal ornaments are fabricated by casting the same within the master mold. Various metals, such as, for example, white and yellow gold, sterling silver, silver, copper, lead, bronze, and alloys containing the same, may be employed in fabricating the ornaments. While the ornaments may be utilized in any manner, they have been found to be especially useful and desirable as jewelry items such as, for example, pendants, charms, pins, buckles, and the like.

BRIEF DESCRIPTION OF THE DRAWING

Various other objects, features, and attendant advantages of the present invention will be more fully appreciated as the same becomes better understood from the following detailed description when considered in connection with the accompanying drawing, wherein:

The SOLE FIGURE is a schematic flow chart of the metal ornament fabrication process of the present invention.

DETAILED DESCRIPTION OF THE PREFERRED EMBODIMENT

Referring now to the drawing, there is schematically illustrated the metal ornament fabrication process of the present invention, the same being generally indicated by the reference character 10. In accordance with the process of the present invention, a particular design is desired to be incorporated within a metal ornament, such as, for example, a jewelry piece, and the design may be either an abstract, a geographical scene, an individual's portrait, or the like. The design may also be embodied within a photograph, a drawing, a model, or any other real manifestation from which an image may be reproduced by optical projection means. In order to produce such an image, a conventional camera lucida is employed whereby the image of the subject or model object can be projected onto a first working medium, such as, for example, an artisan's easel, canvas, drawing paper, or the like. This step of the inventive process is depicted in the FIGURE by the reference character 12.

The projected image of the subject or object is preferably quite large in order to provide a satisfactory depiction of the subject or object design details, however, it is not normally desired to produce metal ornaments, particularly, for example, jewelry pieces, of a corresponding size. Consequently, the size of the projected design must be reduced without a loss of the design details. This is able to be accomplished by means of a conventional pantograph apparatus as illustrated by reference character 14 of the process.

As is well known, a pantograph comprises an arrangement of articulated bars pivotally fastened together, and includes a scribing stylus and a marking or drawing implement. The pantograph can be utilized either for image reproduction enlargements or reductions, and the stylus and marking implements may be secured within either the image-reproducing tracing portion of the apparatus or within the reproduced-image portion of the apparatus. In accordance with the present invention, in view of the fact that an image reproduction reduction is to be achieved, and in view of the additonal fact that the image is to be transferred from the first aforenoted type of working medium to a second working medium, such as, for example, a paraffin type casting wax, the scribing stylus will be disposed within the reproduced-image portion of the apparatus and operatively associated with the casting wax, while the marking or drawing implement will be disposed within the image-reproducing portion of the apparatus and operatively associated with the drawing paper.

While the pantograph may be employed to transfer the details of the object design from the first working medium to the casting wax model directly from the image projected upon the first working medium, it is preferred to delineate the image upon the first working medium by means of a simple drawing or tracing process with respect to the lines comprising the object image as projected onto the working medium by means of the camera lucida. This is optionally shown in the FIGURE at 16 and is a preferred technique due to the fact that the artisan is then able to work from a real, delineated image, as opposed to working from a projected image, when utilizing the pantograph for the image reproduction. In addition, the first working medium, having the object design delineated thereon, may then be removed from the camera lucida apparatus so as not to hinder or interfere with the pantographic reproduction process. Enhanced design detail reproduction is also able to be achieved when the pantographic reproduction is performed in conjunction with the delineated image as opposed to the projected image.

Subsequent to the formation of the casting wax model, a master mold for casting the metal ornaments is produced by means of lost wax techniques as denoted by reference character 18. Prior to the formation of the master mold, it may be preferable to manually work the casting wax model in order to refine the details of the ornamental design beyond the state created by means of the pantographic apparatus. For example, shading and depth characteristics may be imparted to the design in a manner not practically feasible by means of the pantographic image reproduction. This technique is obviously preferred, for again, greatly improved results are achieved due to the enhancement of the reproduced design details, as disclosed at 20.

In forming the master mold, conventional mold plaster material encases the casting wax model, and as is well known, as the plaster hardens or sets, an exothermic process occurs. The generated heat causes the wax of the model to melt and be lost, whereby the remaining mold structure constitutes a master casting mold.

Lastly, the metal ornaments to be fabricated are cast within the master mold. It is to be noted that the cast ornaments are identical replicas of the original casting wax model due to the fact that an intermediary master mold was created. Otherwise, mirror-images of the casting wax model would be fabricated, and not identical replicas. For example, if the object design were such that male and female portions were reproduced within the casting wax model, respectively, then such portions would result in female and male portions, respectively, being produced within the master mold. Ultimately, the cast ornaments would be characterized by male and female design portions, respectively, as desired in order to in fact be identical replicas of the casting wax model, as disclosed at 22.

The metal ornaments may of course be fabricated of various metals, such as, for example, white and yellow gold, sterling silver, silver, copper, lead, bronze, and alloys containing the same. In addition, while the ornaments may comprise, for example, various artistic objects, they have been exemplified as jewelry items, and may comprise, for example, pendants, charms, pins, buckles, or the like.

The ornaments may be removed from the master mold upon sufficient cooling being attained, and by running water over the mold-casting assemblage. Upon removal of the cast ornament from the mold, the same may be manually worked in order to remove any excess metal therefrom. The same may also be subsequently cleaned and polished so as to be acceptable for cosmetic jewelry purposes.

Obviously, many modifications and variations of the present invention are possible in light of the above teachings. It is to be understood therefore that within the scope of the appended claims, the present invention may be practiced otherwise than as specifically described herein.

What is claimed as new and desired to be secured by Letters Patent of the United States, is:

1. In a process for the fabrication of metal ornaments having a design of a subject or object depicted thereon, the steps consisting of:

(a) using a camera lucida to project an image onto a first medium used for drawing and tracing said image onto said first medium so as to set forth all design details of said subject or object;

(b) using a pantograph to reproduce said image from the first medium directly onto a casting wax medium;

(c) refining the details of the design on said wax medium;

(d) forming a master mold by lost wax techniques; and (e) casting metal ornaments within said master mold so as to have said image of said subject or object depicted upon said ornaments.

2. The process of claim 1 wherein said details of the design are refined by impressing shading and depth characteristics of the design on said wax medium.

3. The process of claim 1 wherein said pantograph is used to either enlarge or reduce the image from the first medium onto said casting wax medium.

* * * * *